US008756837B2

(12) United States Patent
Wattel et al.

(10) Patent No.: US 8,756,837 B2
(45) Date of Patent: Jun. 24, 2014

(54) FASTENING DEVICE FOR A COLLECTOR OF SOLID REMAINS SWIVELING AT THE END OF A MOBILE ARM IN PARTICULAR FASTENING DEVICE FOR ARTICULATED BUCKETS OF A CRUST SHOVEL

(75) Inventors: Arnaud Wattel, Tourcoing (FR); Stéphane David, Lomme (FR)

(73) Assignee: E.C.L., Ronchin (FR)

( * ) Notice: Subject to any disclaimer, the term of this patent is extended or adjusted under 35 U.S.C. 154(b) by 395 days.

(21) Appl. No.: 13/143,430

(22) PCT Filed: Dec. 8, 2009

(86) PCT No.: PCT/FR2009/001395

§ 371 (c)(1),
(2), (4) Date: Jul. 6, 2011

(87) PCT Pub. No.: WO2010/079266

PCT Pub. Date: Jul. 15, 2010

(65) Prior Publication Data

US 2011/0266279 A1 Nov. 3, 2011

(30) Foreign Application Priority Data

Jan. 8, 2009 (FR) ..... 09 00048

(51) Int. Cl.
*B66C 3/00* (2006.01)
*E02F 3/40* (2006.01)

(52) U.S. Cl.
USPC ..... 37/187; 294/66.23

(58) Field of Classification Search
USPC ..... 37/184, 185, 188, 340, 461, 187; 294/68.23, 106, 119.4, 88, 68.1, 68.21, 294/111, 112; 414/624–626, 723, 725, 739
See application file for complete search history.

(56) References Cited

U.S. PATENT DOCUMENTS 3,814,471 A * 6/1974 Coeurderoy ..... 294/68.23
4,174,131 A * 11/1979 Gregg ..... 294/68.23

(Continued)

FOREIGN PATENT DOCUMENTS

EP 0440488 A 8/1991
EP 0618313 A2 10/1994

(Continued)

OTHER PUBLICATIONS

International Search Report and Written Opinion mailed Mar. 3, 2010 (PCT/FR2009/001395); ISA/EP.

*Primary Examiner* — Robert Pezzuto
(74) *Attorney, Agent, or Firm* — Banner & Witcoff, Ltd.

(57) ABSTRACT

Fastening device designed to fasten a collecting container including: at least one pivot-member assembled so as to swivel around an axis on a mobile arm and including at least one first transverse arm provided with a first fixing structure and at least one second transverse arm provided with axial bores, at least two fasteners fixed onto the collecting container, the first fastener being provided with a second fixing structure working in conjunction with the first fixing structure, the second fastener, provided with axial bores, and a pin, designed to be inserted and to slide inside the axial bores when they are aligned. There exists at least one bore of a group, called the "central bore", which is conical and which is surrounded by two bores of the other group, called "peripheral bores" which are cylindrical. The pin has a conical shoulder complementary to the central bore.

20 Claims, 4 Drawing Sheets

(56) References Cited

U.S. PATENT DOCUMENTS

| | | | | |
|---|---|---|---|---|
| 4,327,943 | A * | 5/1982 | Longo | 294/68.23 |
| 4,908,966 | A * | 3/1990 | Phillips et al. | 37/340 |
| 6,145,517 | A * | 11/2000 | Mancuso | 134/22.1 |
| 6,264,013 | B1 | 7/2001 | Hodgins | |
| 6,643,957 | B2 * | 11/2003 | Piron et al. | 37/187 |
| 7,934,758 | B2 * | 5/2011 | Stamey et al. | 294/106 |
| 2003/0106246 | A1 | 6/2003 | Piron et al. | |

FOREIGN PATENT DOCUMENTS

| | | | |
|---|---|---|---|
| EP | 0677477 | A | 10/1995 |
| EP | 1178004 | A | 2/2002 |

* cited by examiner

FASTENING DEVICE FOR A COLLECTOR OF SOLID REMAINS SWIVELING AT THE END OF A MOBILE ARM IN PARTICULAR FASTENING DEVICE FOR ARTICULATED BUCKETS OF A CRUST SHOVEL

CROSS-REFERENCE TO RELATED APPLICATIONS/PRIORITY CLAIM

The present application is a U.S. National Phase filing of International Application No. PCT/FR2009/001395 filed on Dec. 8, 2009, designating the United States of America and claiming priority to France Patent Application No. 0900048, filed on Jan. 8, 2009, both of which applications the present application claims priority to and the benefit of, and both of which applications are incorporated by reference herein in their entireties.

TECHNICAL FIELD OF THE INVENTION

The invention relates to aluminum production using igneous electrolysis by means of the Hall Héroult process. It more particularly relates to a device designed to collect the solid remains immersed or floating in the electrolyte bath and the molten metal, in particular mud from the electrolytic bath which accumulate on the bottom of the tank as well as the carbon fragments and the remains of crust which come from the various operations carried out before and during the removal of the worn anodes. It relates even more particularly to a device including an articulated bucket shovel and provided with means allowing the quick replacement of said articulated bucket shovel.

BACKGROUND

Aluminum is produced industrially by igneous electrolysis, using the well-known Hall-Héroult process, in electrolysis cells. The plants contain a great number of electrolysis cells laid out in line, in buildings called electrolysis halls or rooms, and electrically connected in series using connecting conductors, in order to make the best use of the floor area of the plants. The cells are generally laid out so as to form two or more parallel lines which are electrically linked to each other by end conductors. In each cell, the electrolyte bath and the molten metal are contained in tanks, called "electrolysis tanks", comprising a steel container, which is coated on the inside with refractory and/or insulating materials, and a cathodic unit located at the bottom of the tank. Anodes, typically made of carbonaceous material, are partially immersed in the electrolyte bath.

When operating, an electrolysis plant requires work on the electrolysis cells, including replacement of worn anodes by new ones, sampling of molten metal in the cells and sampling or top-ups of electrolyte. In order to carry out this work, the most modern plants are generally equipped with one or more service units including an overhead traveling crane which can be relocated above the electrolysis cells, along series of cells, and one or more service machines each including a carriage able to be moved on the overhead traveling crane, and a service module provided with handling and servicing devices such as shovels and hoists, commonly known as "tools". These service units are often called "Pot Tending Assemblies" (PTA) or "Pot Tending Machines" (PTM). The service module generally includes a tool-holder turret, each tool either being fixed at the end of a cable operated by a winch attached to said tool-holder turret, or fixed at the end of a mobile, typically telescopic or articulated arm, the other end of which is attached to said tool-holder turret.

One of the operations necessary during the anode replacement is the cleaning of the part of the liquid medium made up by the bath and the molten metal which was covered by the worn anode and which must be covered by the new anode. During electrolysis, a hard crust of fluorinated cryolite and alumina is formed on the upper surface of the bath. This crust has the advantage of storing the heat within the bath and therefore provides an effective insulating envelope. But it is extremely hard and adheres to the wall of the anode block, so that it proves to be necessary to break it around the worn anode, in order for the latter to be extracted. Typically, the crust is broken up out using tools such as tappers, called "crustbreakers". During removal of the worn anode, there then forms an opening in the crust, which is left until the new anode is fitted and which we will thereafter refer to as the "anode hole". Breaking up the crust and handling the worn anode block inevitably generate the formation of solid pieces or parts which float on, or remain in suspension in the liquid medium made up by the electrolyte bath and the molten metal, or which fall to the bottom of the tank. It turns out to be necessary to remove these solid parts by means of a collecting tool, commonly known as a "crust shovel". In addition, mud settles gradually to the bottom of the tank, i.e. on the cathode, forming an increasingly thick layer, which increases resistance and consequently reduces the output of said tank. The crust shovel in the anode hole is therefore also used to also remove this mud which has accumulated on the bottom of the tank.

European patent application EP-A-0 440 488 described an example of a crust shovel in conjunction with a particular vehicle, as distinct from a service machine. European patent application EP-A-0 618 313 described in a far from detailed way an example of a service machine equipped with a device able to break up the crust in the vicinity of a worn anode and to clean the anode hole. Whether it is conveyed by a special vehicle or a service machine, the crust shovel commonly used takes the form of a grip made up of two buckets placed in a substantially symmetrical way in relation to a substantially vertical plane and articulated, swiveling around two substantially horizontal axes, that may be one and the same. Each bucket has a leading edge, also called a "blade", opposite the leading edge of the other shovel. To collect the remains, the crust shovel, in open position, is plunged into the bath, and then the crust shovel is moved from an open position to a closed position, by using at least one actuator which works either directly on a bucket, or on a connecting rod assembly designed to make the buckets rotate substantially symmetrically in relation to each other, the solid remains located between the two buckets being therefore trapped, while the liquid medium, a mixture electrolyte bath and molten metal, can still escape, in particular through openings worked into the walls of the buckets. Patent application EP 1 178 004 describes such a bucket shovel, with a special duplicated frame.

The conditions in which the shovel is used, especially its buckets, designed to plunge into the liquid medium made up by the liquid bath floating on top of the molten metal, are particularly demanding, from both the heat and the mechanical standpoints, requiring frequent repairing of said bucket shovel. In general, this repair work requires replacement of the buckets, which takes several hours and requires the whole device, namely of the vehicle or the service machine provided with all its tools, to be shut down.

BRIEF SUMMARY

The applicant, continuously seeking to improve the availability of the service machine, which has to fulfill many other functions on the electrolysis cell, therefore set himself the aim of reducing the time spent working on the crust shovel to repair it. In designing a new fastening device for the buckets in order to attain this aim, the applicant realized that the device was also applicable to collecting units other than the crust shovels used when manufacturing aluminum by igneous electrolysis and that it could be applied to any articulated collecting container, swiveling around an axis at the end of a mobile arm.

The subject of the invention is a fastening device designed to fasten a collecting container swiveling around an axis at the end of a mobile arm, said collecting container, typically a bucket, having an opening making it possible to collect solid remains during said swiveling movement, including:

a. at least one pivot-member assembled so as to swivel around said axis on said end of the mobile arm and including:
   - at least one first transverse arm provided with a first fixing means and
   - at least one second transverse arm provided with a first group of m bores directed in a direction parallel to the axis;

b. at least two fasteners fixed onto said container:
   - the first fastener being provided with a second fixing means working in conjunction with said first fixing means of said pivot-member, so that, when they come into contact with each other, it is used as guide and then as a stop to the first fixing means when said pivot-member swivels around its axis in a given direction of rotation;
   - the second fastener, provided with a second group of n bores turned in a direction parallel to the axis, placed so that when said pivot-member swivels in said direction of rotation until said first fixing means comes up against said second fixing means, the m bores of said first group of bores and the n bores of said second group of bores are substantially aligned in a common axial direction;

c. a pin, designed to be inserted and to slide in the alignment of said (m+n) bores, in order to fix said collecting container onto said end of the mobile arm;

characterized in that:

d. integers m and n are equal to or greater than 1, the product m*n being strictly greater than 1;

e. when the (m+n) bores are aligned, there exists at least one bore of a group, called "central", which is conical and which is surrounded by two bores of the other group, called "peripheral", which are cylindrical and have different diameters;

f. said pin is a twin-cylindrical shaft with a conical shoulder including:
   - f1) two cylindrical parts, each cylindrical part having a substantially equal diameter, slightly lower than the diameter of the peripheral bore in which it is designed to slide,
   - f2) and a conical intermediate part, the slope of which is similar to that of said central bore.

According to the invention, the fastening device includes a pivot-member which is interdependent of the mobile arm and which is provided with transverse arms. The latter may include one or more flanges which extend in a substantially radial direction. The fastening device is also provided with means placed on the transverse arms of said pivot-member, and also on fasteners fixed onto the collecting container. These means are complementary fixing and blocking means. The complementary blocking means are a pin and bores which, once aligned, work in conjunction with said pin to block the connection between said container and said mobile arm. The pivot-member could be interdependent of the collecting container and the fasteners could be interdependent of the mobile arm but such a configuration is not really required, insofar as it is easier to control the movement and the rotation of the pivot-member, when the latter is associated with the mobile arm.

The second transverse arm and the second fastener are provided with m and n bores respectively, directed in a direction parallel to the axis of the pivot-member. Numbers m and n are integers equal to or greater than 1. According to the invention, it is a requirement that the product (m*n) be strictly higher than 1, i.e. if m is equal to 1, n is inevitably higher than 1 or vice versa, so that there are at least two bores of one group to surround one bore of the other group. When m or n is greater than two, the bores of the corresponding group are not only directed but also aligned in a given direction parallel to the axis.

To perfect blocking, it is advantageous to complete said device with complementary means for axial immobilization of said pin, for example means taking advantage of the structure of said pin, in particular its conical intermediate part, to trap said pin, by exerting opposite bearing forces on both the transverse face of said pin located on the side of the large diameter cylindrical part and on the wall bearing the small diameter peripheral bore, on a transverse face located on the side opposite the large diameter peripheral bore.

According to the invention, there exists at least one bore of a group, called the "central bore", which is conical and which is surrounded by two bores of the other group, called "peripheral bores". This implies that, if it is a second cross shaft of the pivot-member which bears said peripheral bores, said second cross shaft includes two flanges parallel to each other, which each bear a peripheral bore and which are separated by a distance greater than the thickness of the second fastener which bears said central bore. Reciprocally, if it is a second fastener of the collecting container which bears said peripheral bores, said second fastener is duplicated and comprises two walls, which we will for convenience also call flanges, parallel to each other and separated by a distance greater than the thickness of the second transverse arm which bears said central bore.

Connection between the collecting container and the mobile arm is made by means of blocking, in this case, bores which, once aligned, work in conjunction with a pin which is characterized by the fact that it includes two cylindrical parts of different diameters, each part having a slightly lower diameter than that of the peripheral bore inside of which it is designed to slide, separated by a conical intermediate part the slope of which is similar to that of the central bore. The association of these bores and this pin has a first advantage: it makes it easier to fit the collecting container onto the mobile arm. According to preferred methods of the invention, it also makes it possible to center the collecting container in relation to its support and it makes it possible to minimize, or even eliminate the radial and axial play between pin and bores.

The association of these bores and the pin according to the invention facilitates assembly: it is always tricky to position the end of the mobile arm in relation to the collecting container, in particular because visual access to the end of the mobile arm from the control cabin is often limited. The result of this is that central bore and the peripheral bores are never perfectly coaxial. The advantage of the special shape of the pin is to facilitate introduction of the pin into the alignment of the bores: it is first inserted through the small diameter cylindrical part, making it pass through the large diameter peripheral bore, then the conical bore, and finally the small diameter peripheral bore. During this movement, a conical fitting is set up which, when the axes do not coincide, entrains a relative radial movement of the wall (transverse arm or fastener) which bears the central bore in relation to the flanges which bear the peripheral bores.

According to a preferred method of the invention, the association of these bores and pin also make it possible to center the collecting container in relation to its support: the flange bearing the small diameter peripheral bore is provided with a sleeve projecting in the direction of the other flange, whose bore is the small diameter peripheral bore and whose projecting end acts as an axial stop for the wall, belonging to said second transverse arm or said second fastener, which bears said central bore. The axial height of this projecting part of the sleeve can be defined according to the axial shift concerned. Therefore, in order to perfectly center the collecting container in relation to its support, the value aimed at for the axial height of this projection in relation to the flange bearing the small diameter peripheral bore corresponds to half of the difference between the distance between the opposite faces of the flanges which bear said peripheral bores and the thickness of the wall which bears said central bore. During introduction of the pin into the bore alignment, the conical fitting, when the wall which bears the central bore is not perfectly centered in relation to the flanges bearing the peripheral bores, makes it possible to entrain the wall bearing the central bore until it arrives up against the end of the projecting sleeve in relation to the flange bearing the small diameter peripheral bore, the axial height of this projection allowing perfect centering of said wall in relation to said flanges.

To perfect blocking, it is advantageous to supplement said device with means to trap said pin, on its transverse face located on the side of the large diameter cylindrical part and the wall bearing the small diameter peripheral bore, on a transverse face located on the side opposite to the large diameter peripheral bore. These means may, for example, include a screw and a nut, the body of the screw being inserted inside said axial bore, the screw head and the nut bearing directly or via washers on the end of said pin close to the large diameter cylindrical part and on a transverse face interdependent of said flange and located on the side opposite the large diameter peripheral bore. Obviously, said face may be the other end of the projecting sleeve or the external wall of said flange.

Advantageously, said first fixing means and said second fixing means are a tenon parallel to said axis and at least one slot designed to receive and guide said tenon until it comes up against the bottom of said slot. Obviously, each of these means may be interdependent of the mobile arm or the collecting container. These means work in conjunction with each other in the following way: when, as a result of the movement of the mobile arm, said tenon come into contact with a first wall bordering said slot, the pivot-member is made to swivel in a given direction of rotation, chosen so that said tenon leaves this first edge and moves, passing through said slot until it reaches the wall which forms the other edge of said slot. The rotation of the pivot-member continues and the tenon is guided by this second edge until it comes up against the bottom of said slot. Obviously, the edges of the slot are of unequal lengths: that of the second edge is shorter in order to let the tenon move in front of its end before it come into contact on the first edge but it is long enough to trap the tenon, when it "goes back up", moved by the rotation of the pivot-member.

The second fastener, which bears the second group of bores, is placed on the collecting container at a distance from the first fastener so that, when said first fixing means and second fixing means work in conjunction, said pivot-member is in a position where the bores of the first group of bores and those of the second group of bores are substantially aligned along a common axial direction. In other words, the distance between centers of the first fixing means and the bores of the first group of bores are substantially equal to the distance between centers of the second fixing means and the bores of the second group of bores. But the distance between centers of the second fixing means and the bores of the second group of bores depends on the long-term behavior of the fasteners of the collecting container, which has to work under difficult conditions, where the risk of impacts likely to modify said distance between centers is considerable.

This may lead to an amount of play such that, as a result of the loads made on the collecting container, the latter moves in relation to its support and bends the fixing means, the bores and/or the pin because of its own inertia. In particular, when the collecting container is the bucket of a crust shovel, such play is to be avoided because it can quickly grow as a result of a special action called "banging" (see below) carried out on said crust shovel. Advantageously, in order to minimize, and preferably to eliminate, play between the container and its support on the mobile arm, the distance between centers of said first fixing means and the bores of said first group of bores is slightly greater, typically by several tenths of millimeters, for example between 0.4 and 1.6 mm for a distance between centers of 350 mm, than the distance between centers of said second fixing means and the bores of said second group of bores. As the pin of the device according to the invention has a conical shoulder, this makes it possible to take up this play and to keep the collecting container within its support.

Preferably, to facilitate operations when detaching the old collecting container and attaching a new collecting container, the fastening device includes only a limited number of pins (one or two) and the number (n+m) of bores associated with each pin is as low as possible, preferably three. In addition, for said fastening to better withstand a force directed perpendicular to the axis, it is advantageous to duplicate either said fixing means, or the groups of bores associated with a pin, or even all these fastening means and to place them at each axial end of said collecting container.

In a preferred embodiment of the invention, said collecting container is a bucket bounded by an axial wall, i.e. a surface with a straight-line generatrix parallel to the axis and bearing on an open direct curve, and two transverse walls, and in which:

- said pivot-member includes, in the vicinity of each of its ends, a first transverse arm used as support for a tenon directed axially and, in the vicinity of its center, a second transverse arm including a first flange bearing a large diameter bore and a second flange, parallel to the first flange and bearing a small diameter bore,
- said axial wall of said bucket includes:
  - two first fasteners, each provided with a slot, placed axially and separate from each other by a distance typically close the length of said tenon, each slot of each first fastener being designed to receive and guide said tenon until it comes up against the bottoms of said slots;
  - a second fastener provided with a conical bore, placed so that said distance between the axis of the conical bore and the line connecting the centers of the curves of said bottoms of said slots is slightly lower, typically by several tenths of millimeters, preferably between 0.4 and 1.6 mm for a distance between centers of approximately 350 mm, than the distance between the axis of said tenon and the common direction of the large diameter and small diameter bores.

Advantageously, said pivot-member is actuated by at least one actuator which is also used to actuate said collecting container and which is assembled interdependently of said mobile arm. In other words, for the fastener of the collecting container or the bucket onto the mobile arm, the actuators which are additionally used to close and open said collecting container or bucket are used. Preferably, said actuator is a jack and said pivot-member includes at least one transverse arm provided with a clevis pin on which a rod connected to said jack can be fitted so as to swivel. Of course, depending on the space configuration and size considerations, said first transverse arm, said second transverse arm or a third transverse arm can act as a support for the swivel connection with said rod.

Preferably, the fastening device is designed so that fastening occurs during a movement of the pivot-member corresponding to the closing of said collecting container, i.e. to the movement made for the collection of solid remains. In other words, the "given direction of rotation", during which the fixing means work in conjunction, is preferably the rotation movement corresponding to the closing of the collecting container. To achieve this, said first fastener is placed close to the opening of said container and is provided with a slot towards the side opposite to said opening. In this way when the tenon comes into contact with the first edge bordering the slot, said pivot-member is subjected to a rotation movement in the direction of the closing of the collecting container so that said tenon is entrained towards the other edge of the slot, the latter being used as guide for the tenon until it reaches the bottom of said slot.

Another subject according to the invention is a fastening device designed for the simultaneous fastening of two buckets opposite each other, substantially symmetrically in relation to a plane P1, characterized in that it comprises, associated with each bucket, placed substantially symmetrically in relation to a plane P2, a fastening device as described previously, the mobile arm being actuated by a first actuator so that with a view to fixing, plane P1 can coincide with plane P2, the pivot-member of the first bucket and the pivot-member of the second bucket each having at least one transverse arm that has a swivel connection with a common rod, known as a "connecting rod", connected to at least one second actuator, interdependent of said mobile arm. Typically, the swivel connection can be made by a clevis pin, on which said rod is assembled so as to swivel. The clevis pins are placed in relation to the pivot-members which support them so that a relative movement of said connecting rod is translated, for each bucket, into a substantially symmetrical rotation movement in relation to said plane P1. As indicated above, if the space configuration allows, said transverse arm provided with a swivel connection with said connecting rod can be said first transverse arm, said second transverse arm or a third transverse arm.

Preferably, fastening the buckets corresponds to a closing movement of the buckets and, conversely, old buckets are detached with an opening movement. Advantageously, between detaching the old buckets and attaching the new buckets, the second actuator is immobilized in order to stop the pivot-members from rotating, so that, during fastening of the new buckets, the first fixing means are in the right position from the start when they make contact with the second fixing means.

Advantageously, for reasons of accessibility when fitting the pins, the first fixing means are closer to the symmetry plane P2 than the first group of bores and the second fixing means are closer to the symmetry plane P1 than the second group of bores.

Another subject according to the invention is a collection unit comprising a mobile arm, at least one collecting container actuated by at least one actuator interdependent of the mobile arm and, associated with said collecting container, at least one fastening device as described above.

Another subject according to the invention is a collection unit comprising a mobile arm, two buckets placed opposite each other, actuated simultaneously, typically by means of a connecting rod, by at least one actuator interdependent of said mobile arm, and a fastening device for said buckets characterized in that said fastening device is a fastening device allowing simultaneous fastening of said buckets as described above, fastening being possible when said buckets have been previously placed substantially symmetrically in relation to said plane P1.

A particular embodiment of said collection unit includes:

a) a mobile arm;

b) a frame, fixed onto said mobile arm;

c) two buckets, each bucket having an axial wall and two transverse walls and being articulated, swiveling around a direction parallel to an axis, said buckets being placed substantially symmetrically in relation to a substantially vertical plane P, each bucket having a leading edge opposite the leading edge of the other bucket, so that said solid remains located between the two openings of said buckets are trapped by said buckets. Said collection unit also includes, assigned to each of said buckets and placed substantially symmetrically in relation to said substantially vertical plane P, fastening devices, each including:

- a pivot-member, assembled so as to swivel on said frame, comprising at least one first transverse arm provided with a first fixing means and at least one second transverse arm provided with a first group of m bores directed along a direction parallel to said axis;
  - at least two fasteners fixed onto each bucket, the first fastener being provided with a second fixing means working in conjunction with said first fixing means of said pivot member, and the second fastener, provided with a second group of n bores directed along a direction parallel to said axis, placed so that, when said first fixing means and second fixing means work in conjunction, said pivot-member swivels until it reaches a position where the bores of said first group of bores and said second group of bores are substantially aligned along a common axial direction;
- a pin, designed to be inserted and to slide in the alignment of said first group of bores and second group of bores, in order to fix said buckets to said frame;
- the bores of said first group of bores and said second group of bores being arranged so that, when they all are substantially aligned along a common axial direction, there exists at least one bore of a group, called the "central bore", which is conical and which is surrounded by two bores of the other group, called "peripheral bores", which are cylindrical and have different diameters;
- said pin being a shaft comprising two cylindrical parts, each cylindrical part having a substantially equal diameter, slightly lower than the diameter of the peripheral bore in which it is designed to slide, and a conical intermediate part, the slope of which is similar to that of said central bore.

Advantageously, each pivot-member includes, in the vicinity of each of its ends, a first transverse arm used as support for a tenon directed axially and, in the vicinity of its center, a second transverse arm including a first flange bearing a large diameter bore and a second flange, parallel to the first flange and bearing a small diameter bore, The axial wall of each bucket includes the first two fasteners each provided with a slot towards the side opposite to the opening of said bucket, placed axially in the vicinity of said opening and separated from other by a distance typically close to the length of said tenon, each slot of each first fastener being designed to receive and guide said tenon until it comes up against the bottoms of said slots and a second fastener provided with a conical bore, placed far from said opening, so that said distance between the axis of the conical bore and the line connecting the centers of the curves of said bottoms of said slots is substantially equal, and preferably slightly lower, typically by several tenths of millimeters, than the distance between the axis of said tenon and the common direction of the large diameter and small diameter bores.

Advantageously, said mobile arm is a mobile vertical mast actuated by a first actuator which moves said mobile vertical mast along its vertical axis and the pivot-members associated with the first bucket and the second bucket each have at least one transverse arm bearing a swivel connection with a connecting rod connected to at least one second actuator, interdependent of said mobile arm, said swivel connections being placed on each transverse arm so that a relative movement of said connecting rod is translated, for each one of said pivot-members, by a substantially symmetrical rotation movement in relation to said plane P2, which is substantially vertical. To fasten the buckets, the vertical mobile mast, typically borne by the carriage of an overhead traveling crane, is placed above all the buckets placed substantially symmetrically in relation to a substantially vertical plane P1 and is then is brought down using the first actuator until the first fixing means come into contact with the second fixing means. The second actuator is then actuated to move the connecting rod and simultaneously to rotate the buckets, preferably in the direction of closing.

Another subject according to the invention is a crust shovel designed to collect the solid remains and mud found in the liquid media of an aluminum production cell (electrolyte bath and metal), in particular designed to clean the anode holes, characterized in particular in that it is a collection unit as previously described. Advantageously, the mobile vertical mast, called here a "shovel stem", is the moving part of a telescopic mast connected to the tool-holder turret of the mobile carriage of a pot tending assembly. Preferably, the distance between centers of the first fixing means and the bores of the first group of bores are slightly greater than the distance between centers of the second fixing means and the bores of the second group of bores, which makes it possible to provide fixing without any play in the buckets. As indicated above, the absence of play is highly recommended when the buckets of a crust shovel are involved. Part of the liquid medium, made up of the electrolyte bath and liquid aluminum, which is very viscous, adheres to the bucket walls, so that said buckets are covered with gangue which must be removed each time the crust shovel goes into the tank. Failing this, the buckets very quickly become clogged and inoperative. To remove as much bath and metal as possible, which cool and solidify, adhering to the surface of the buckets, an operation called "bucket crashing" is performed as often as necessary: the actuator is used to swivel the buckets with a closing movement so said that said leading edges of the buckets come suddenly into contact with each other, the impact needing to be violent enough for said cooled bath and metal to come unstuck and be ejected from the surface of said buckets. As crashing operations are frequent, it is important that said buckets do not move in relation to their supports and do not deform the various means of their fastening device.

Another subject according to the invention is a service machine, that can be used in a plant for producing aluminum by igneous electrolysis, comprising a carriage that can be moved on an overhead traveling crane, and a service module equipped with at least one handling and servicing device, characterized in that said handling and servicing device is a crust shovel as previously described.

Another subject according to the invention is a bucket support designed to work in conjunction with the fastening device for simultaneous fastening of buckets placed opposite each other as described previously. It is characterized in that it includes means to support and maintain in position two buckets placed substantially symmetrically in relation to a vertical plane P1, in a geometrical configuration where the buckets are open, the opening angle being such that, after removing the pins, and after a slight rotation in the opening direction which releases the first fixing means from the second fixing means, a vertical movement at the top of the mobile arm can be made to move away the pivot-members without actuating said buckets. In this way, old buckets can be detached by gravity alone, without having to use another means to retain said buckets. The means of support which make it possible to direct and maintain the buckets in a precise angular position may, for example, be V-notches worked into the uprights of the support and on which the parts of the buckets whose section matches the complementary shapes come to rest.

Advantageously, a second support is used, equipped with the same means to support and hold the buckets in position and which is provided with two new buckets. If, between detaching the old buckets and attaching the new buckets, the second actuator has been immobilized so as to stop the pivot-members from rotating, the first fixing means are in the right position from the start when they make contact with the second fixing means when attaching the new buckets. Previously, bucket replacement required the PTA to be laid up in a maintenance workshop. With the fastening device according to the invention, the bucket supports or racks designed to collect the worn buckets together with the supports provided with new buckets can be brought into in the electrolysis hall ready positioned. Buckets can therefore be replaced very quickly on site, without needing to go through the maintenance workshop. It follows that, by means of the invention, bucket downtime, and consequently that of the PTA, is significantly decreased. In this way, the PTAs are more available for work on the electrolysis cells.

DETAILED DESCRIPTION

Figure 1:
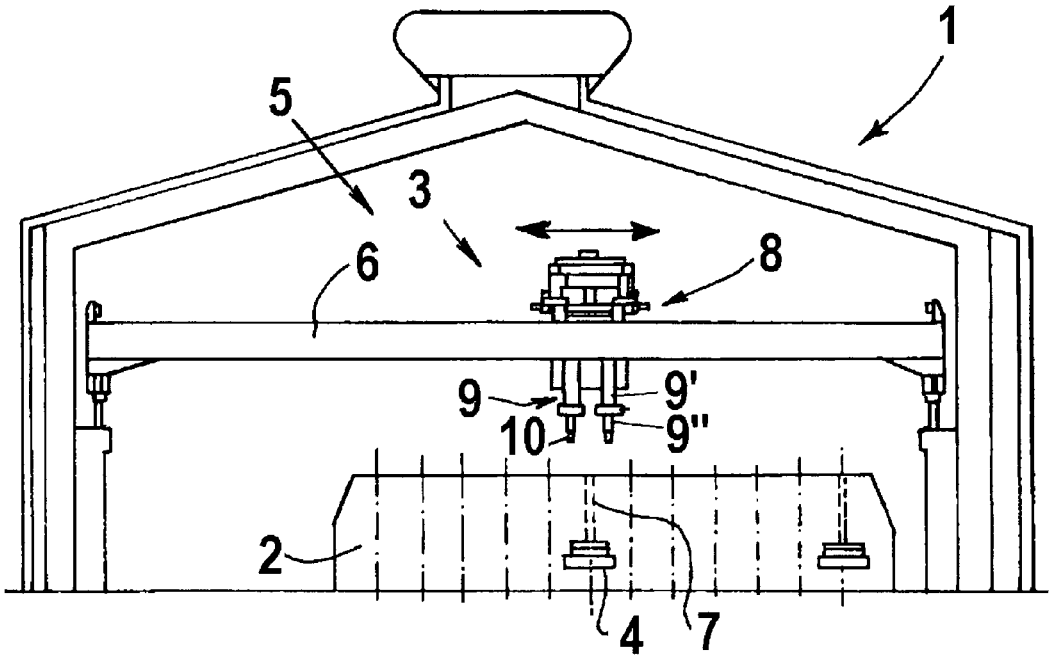
FIG. 1 illustrates a cross-sectional view of a typical electrolysis hall, designed for the production of aluminum and comprising a particular embodiment of the service machine according to the invention, shown schematically.
Figure 2:
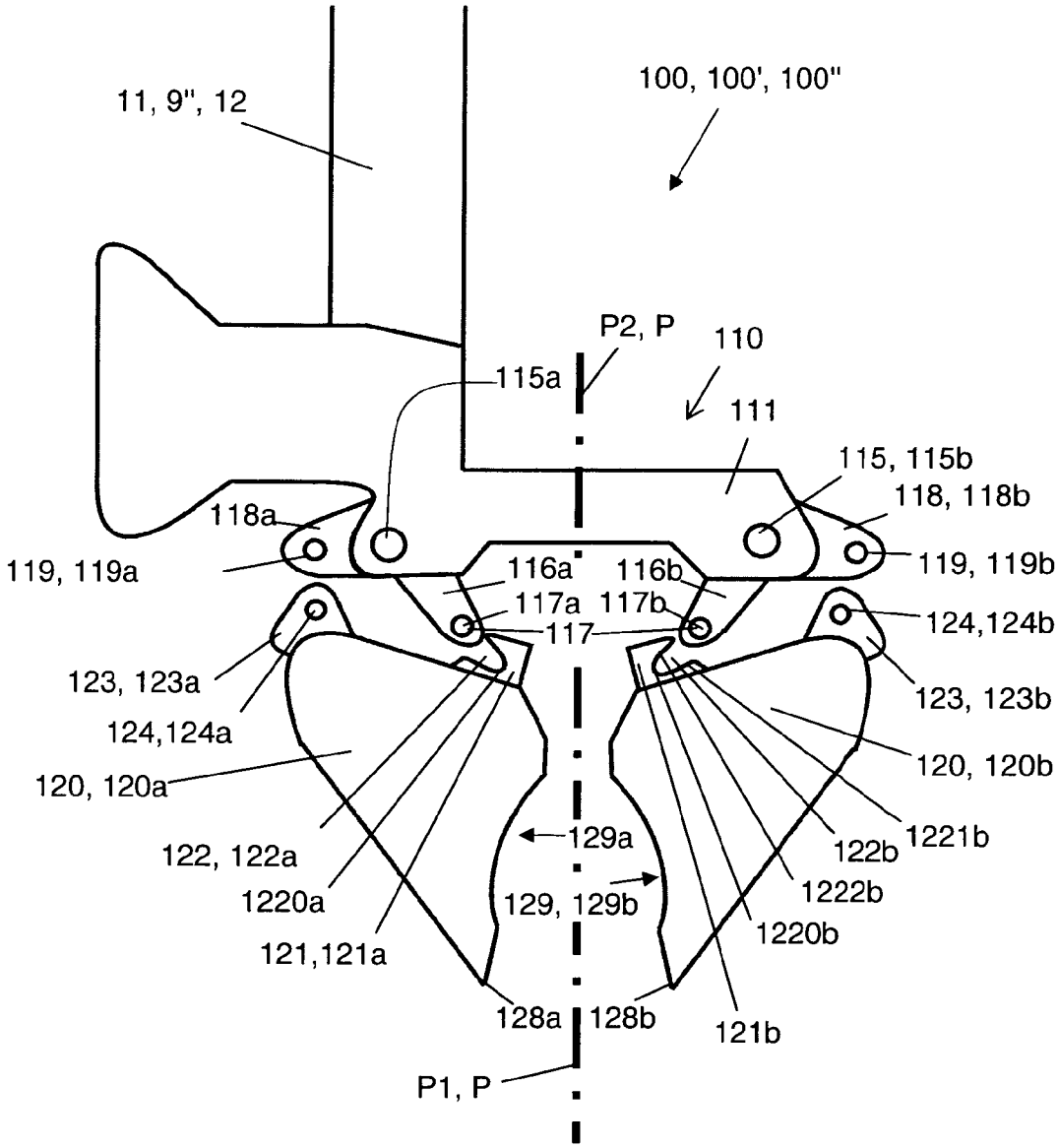
FIG. 2 illustrates a front view of a particular embodiment of a crust shovel according to the invention, assembled on a telescopic vertical guide mast.
Figure 3:
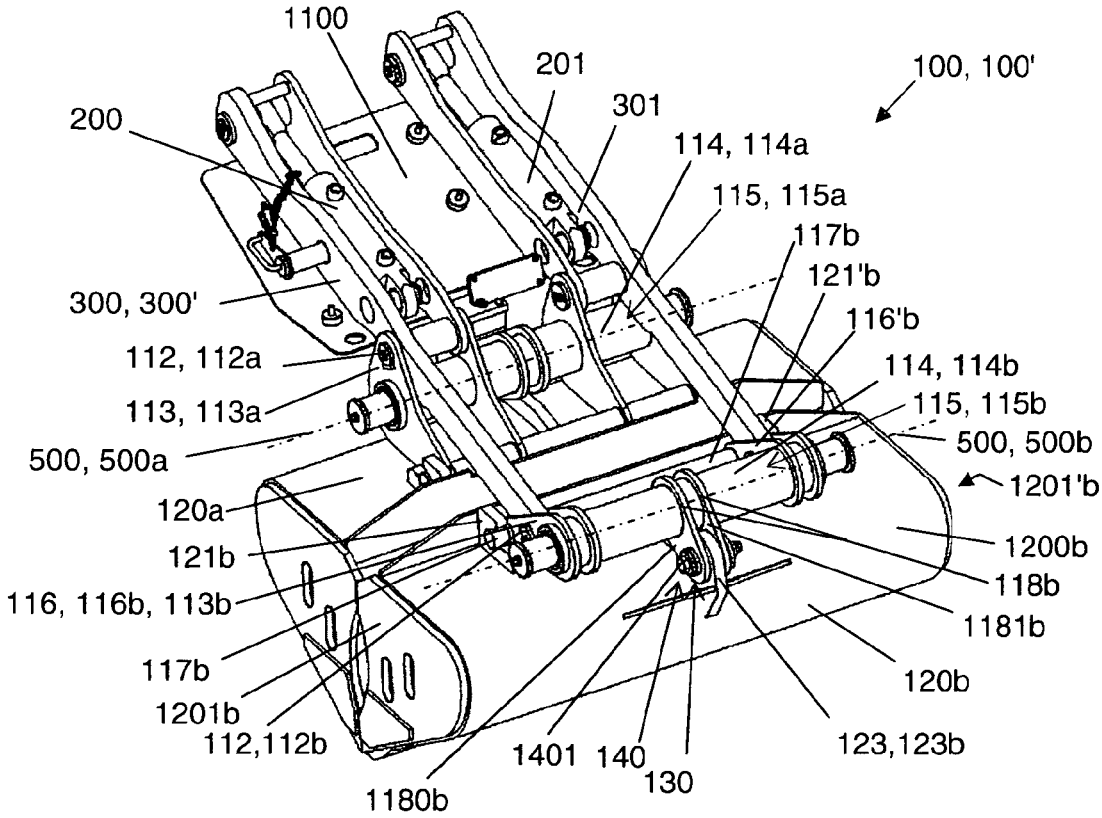
FIG. 3 gives a perspective view of the shovel-holder frame and the bucket shovel of the embodiment shown in FIG. 2.
Figure 4:
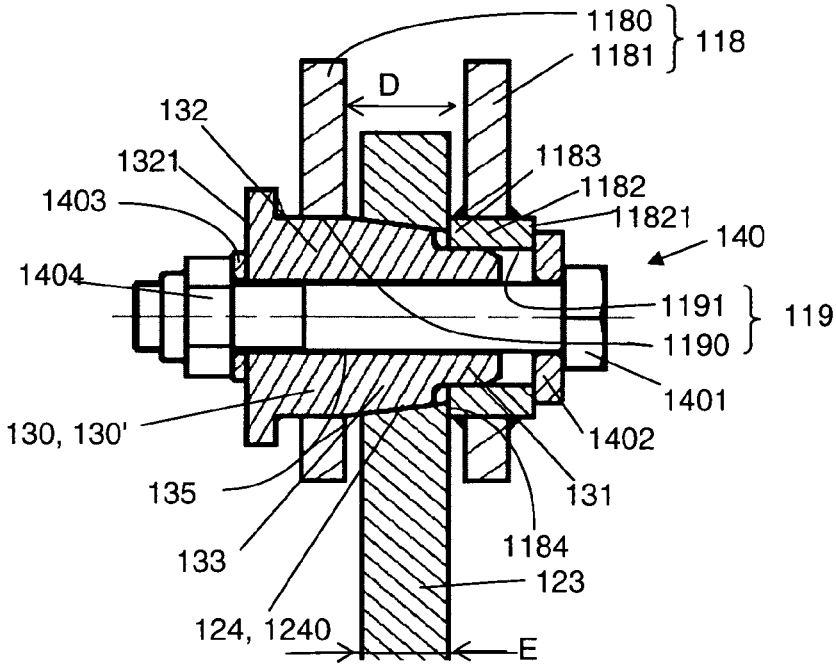
FIG. 4 gives a cross-sectional view of part of the fastening device according to the invention, including the pin and the first and second groups of bores.
Figure 5:
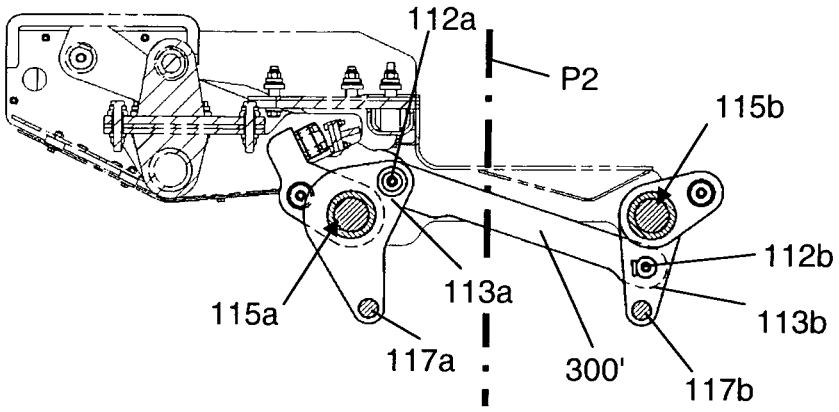
FIG. 5 gives a front view and a cross-sectional view in relation to a vertical median plane, of a fastening device designed for the simultaneous fastening of two buckets placed opposite each other.
Figure 6:
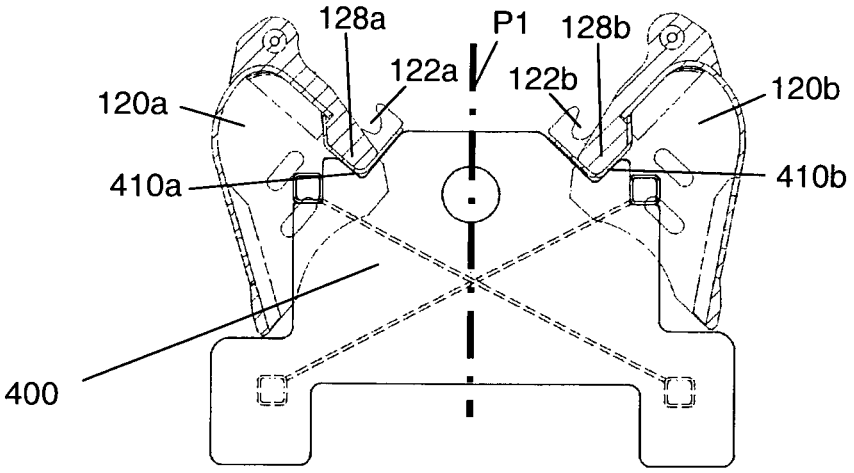
FIG. 6 gives a front view and cross-sectional view in relation to a vertical median plane of a bucket support adapted to work in conjunction with the device shown in FIG. 5.
Figure 7:
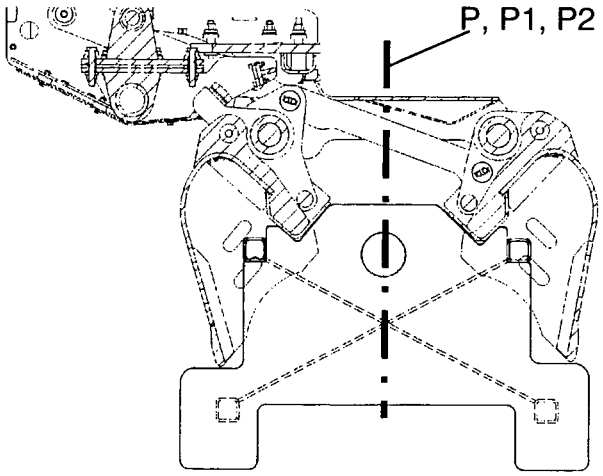
FIG. 7 gives a front view and a cross-sectional view in relation to a vertical median plane, of the device shown in FIG. 5 set up on the support shown in FIG. 6 and in the configuration where buckets are ready to be fastened simultaneously.

Electrolysis plants for the production of aluminum include a liquid aluminum production area containing one or more electrolysis halls. The electrolysis hall (1) illustrated in FIG. 1 comprises electrolysis cells (2) and a service machine (5). The electrolysis cells (2) are normally laid out in row or files, each row or file typically comprising over a hundred cells. The cells (2) are laid out so as to leave an aisle along the electrolysis hall (1). Cells (2) include a series of anodes (4) provided with a metal stem (7) for fixing the anodes and connecting them electrically to a metal anode frame (not shown).

The service unit (5) is used to carry out operations on the cells (2) such as changing anodes or filling the feed hoppers with crushed melt and aluminum fluoride (AlF3). It can also be used to handle various loads, such as tank parts, ladles of liquid metal used during tapping ("tapping ladles") or anodes. It can also be used to clean the anode hole, after the removal of a worn anode and before fitting a new anode.

The service unit (5) includes an overhead traveling crane (6) which can be relocated above the electrolysis cells (2), and one or more service machines (3) including a mobile carriage (8) able to be moved on the overhead traveling crane (6). The mobile carriage (8) includes a tool-holder turret which is equipped with several handling and servicing devices (10), such as tools, one of which may be the crust shovel. As we have seen previously, a crust breaker can also be moved and operated from a vehicle other than a service machine and the invention may apply to any crust shovel, no matter how it is moved.

FIGS. 2 to 7 illustrate a particular collection unit (100), which is a crust shovel (100') whose fastening device corresponds to one embodiment according to the invention. The crust shovel (100') is fixed onto a mobile arm (11), which here is a shovel stem (12). The shovel stem is a mobile vertical mast (9") sliding inside a vertical mast (9'), fixed in relation to the tool-holder turret of the mobile carriage (8) of a service machine (3).

The fastening device illustrated makes it possible to simultaneously attach and detach two buckets (120*a* and 120*b*) placed opposite each other substantially symmetrically in relation to a plane P1. It comprises, associated with each bucket, placed substantially symmetrically in relation to a plane P2 which must be made to coincide with P1 (in this case, the common plane is indicated by P), an "elementary" fastener device according to the invention, suitable for fixing only one collecting container (120). Throughout the following, the structural elements of the elementary device are indicated with a reference number but, when they are illustrated on only one of the devices associated with said buckets, they are indicated with a reference number, followed by an *a* or a *b* depending on the bucket concerned.

For each bucket (120), the fastening device includes:

a. a pivot-member (115), assembled so as to swivel around the axis (500) on the end of the shovel stem (9") and including:
   - a first transverse arm (116), here duplicated as two flanges (116*b*, 116'*b*) used as support for a first fixing means (117), which is here a tenon (117*b*);
   - a second transverse arm (118), provided with a first group (119) of 2 bores aligned along a direction parallel to the axis (500), including a first flange (1180) bearing a large diameter cylindrical bore (1190) and a second flange (1181) bearing a small diameter cylindrical bore (1191);

b. a set of fasteners on the bucket (120), including a pair of fasteners (121*b*, 121'*b*) and a fastener (123):
   - each fastener (121*b*, 121'*b*) of the pair of fasteners is provided with a second fixing means (122), here, a slot (122*b*). The tenon (117*b*) and the opening (122*b*) work in conjunction so that, when said tenon comes into contact with a first wall (1221*b*) bordering said slot, the pivot-member (115*b*) is made to swivel following the closing direction, so that said tenon leaves this first contact, and moves as far as a second contact on the wall (1222*b*) which forms the other edge of said slot. This second edge guides the tenon during rotation of the pivot-member until it comes up against the bottom (1220*b*) of said slot;
   - the other fastener (123) is provided with a second group (124) of bores including a conical bore (1240) directed along a direction parallel to the axis. Said fastener is placed on the bucket so that when the pivot-member (11Sb) swivels in said closing direction until the tenon (117*b*) comes up against the bottom (1220*b*) of the slot (122*b*), the 2 bores (1190 and 1191) of the first group of bores and the conical bore (1240) are substantially aligned along a common axial direction; the conical bore (1240), placed in the middle of two cylindrical bores (1190 and 1191) of the other group, is said to be "central", while cylindrical bores are said to be "peripheral"; the adjectives "conical" and "central" will therefore be used indifferently to qualify the bore which is surrounded by other bores and the adjectives "cylindrical" and "peripheral" indifferently to qualify the bores which surround the central bore;

c. a pin (130), designed to be inserted and to slide inside the alignment of the large diameter bore (1190), the conical bore (1240) and the small diameter bore (1191), is a twin cylindrical shaft with a conical shoulder including:
   - two cylindrical parts (131, 132), each cylindrical part having a diameter substantially equal to, slightly lower than the diameter of the peripheral bore (1191, 1190 respectively) in which it is designed to slide,
   - and a conical intermediate part (133), the slope of which is similar to that of said conical bore (1240).

The association of these bores makes it easier to f.tt each bucket to the pivot-member (115) assembled so as to swivel on the frame (110) interdependent of the shovel stem (12). It also makes it possible to center the bucket in relation to its support and it makes it possible to minimize, or even eliminate the radial and axial play between pin and bores. The particular shape of the pin facilitates its insertion into the alignment of bores, even if the latter is not perfect: it is first inserted through the small diameter cylindrical part (131), making it pass through the large diameter peripheral bore (1190), then the conical bore (1240), and finally the small diameter peripheral bore (1191). During this movement, a conical fitting is set up which, when the axes do not coincide perfectly, entrains a relative radial movement of the fastener (123) which beats the central bore (124) in relation to the flanges (1180 and 1181) which beat the peripheral bores.

The association of these bores and pin also make it possible to center the collecting container in relation to its support: the flange (1181) bearing the small diameter peripheral bore (1191) is provided with a sleeve (1182) projecting in the direction of the other flange (1180). The bore of this sleeve (1182) is the small diameter bore (1191). Its projecting end (1183) has a transverse surface (1184) which is used as an axial stop for the wall of the fastener (123) which bears said central bore (1240). The axial height of this projection (1183) in relation to the flange (1181) bearing the small diameter bore (1191) corresponds to half the difference between the distance (D) between the opposite faces of the flanges (1180 and 1181) which bear said peripheral bores (1190 and 1191) and the thickness (E) of fastener (123) which bears said central bore (1240). During introduction of the pin into the bore alignment, the conical fitting, when the fastener (123) which bears the central bore (124) is not perfectly centered in relation to the flanges (1180 and 1181) makes it possible to entrain the fastener (123) until it arrives up against the end of the axial stop wall (1184) of the projecting end (1183) of the sleeve, the axial height of this projection allowing perfect centering of said wall in relation to said flanges.

To perfect blocking, it is advantageous to supplement said device with means to trap said pin, on its transverse face (1321) located on the side of the large diameter cylindrical part (132) and a wall interdependent of the wall (1181) bearing the small diameter peripheral bore (1191). These means may, for example, include a screw (1401) and a nut (1404), the body of the screw being inserted inside said axial bore (135) of the pin (130), the screw head and the nut bearing directly or via washers (1402) and (1403) on the end (1321) of said pin close to the large diameter cylindrical part (132) and on a transverse face (11821) interdependent of said flange and located on the side opposite the large diameter peripheral bore (1190).

Advantageously, to eliminate play between the bucket and its support, the distance between centers of said tenon (117*b*) and the axis of the large diameter and small diameter bores (1190, 1191) ranges between 345.4 mm and 345.6 mm, whereas, on the bucket, the distance between centers of the bottom (1220*b*) of the slot (122*b*) and the conical bore (1240) range between 344 mm and 345 mm.

In this example, to facilitate operations when detaching the old buckets and attaching new buckets, the fastening device comprises only one pin (130*a*, 130*b*) per bucket (120*a*, 120*b*) and 3 bores associated with said pin. For said fastening to stand up better to a force directed perpendicularly to the axis (500*a*, 500*b*), the fixing means were duplicated: fasteners (121*b*, 121'*b*) which bear the slots which work in conjunction with the tenon (117*b*) were placed at each axial end of the bucket (120*b*). In another embodiment, two pins and 6 bores are used per bucket, i.e. 3 bores associated with each pin. Each group of bores associated with a pin was placed at each axial end of the bucket, in the vicinity of the fixing means, these also duplicated, as in this example. Advantageously, in this other embodiment, there are, at each end of the pivot-member, a first transverse arm and a second transverse arm which are grouped together in the form of two flanges in the shape of a boomerang, one of the ends of the boomerang bearing a cylindrical bore (of small diameter for the first flange; of large diameter for the second flange) and the other end being used as a support for a tenon. The pivot-member therefore bears, at each one of its ends, via the boomerang-shaped double flanges, a tenon and a group of peripheral bores. On each bucket, there are two pairs of fasteners bearing slots and two fasteners bearing a conical bore, the slots of each pair of fasteners working in conjunction with a tenon, each conical bore being designed to be placed in the middle of a group of peripheral bores.

The pivot-members (115), fitted to swivel on the blanks (111) of the frame (110) interdependent of the shovel stem (9"), are actuated by two jacks (200, 201) themselves interdependent of said frame and working simultaneously, each of them being used to set said pivot-members rotating simultaneously via two connecting rods (300, 301). The fastening device is designed so that fastening occurs during a closing movement of the buckets. The pivot-members (115*a*, 115*b*) are provided with a transverse arm (113*a*—third transverse arm, 113*b* the same as the first transverse arm 116*b*) bearing a swivel connection on which said connecting rod (300) is assembled so as to swivel.

Preferably, fastening the buckets corresponds to a closing movement of the buckets and, conversely, old buckets are detached with an opening movement. Advantageously, between detaching the old buckets and attaching the new buckets, the jacks (200, 201) are immobilized in order to stop the pivot-members (115*a*, 115*b*) from rotating, so that, during fastening of the new buckets, the tenons (117*a*, 117*b*) are in the right position from the start in relation to the slots (122*a*, 122*b*).

Advantageously, for reasons of accessibility when fitting the pins (130*a*, 130*b*), the tenons (117*a*, 117*b*) are closer to the symmetry plane P2 than the first groups of bores (119*a*, 119*b*) and the fasteners (121*a*, 121*b*) bearing the slots (122*a*, 122*b*) are closer to the symmetry plane P1 than the fasteners (123*a*, 123*b*) bearing the conical bores.

A bucket support (400) has been provided, designed to work in conjunction with the fastening device described above. It is provided with means to support and maintain in position two buckets (120*a* and 120*b*) placed substantially symmetrically in relation to a vertical plane P1, in a geometrical configuration where the buckets are open, the opening angle being such that, after removing the pins, and after a slight rotation in the opening direction which releases the tenons (117*a*, 117*b*) from the slots (122*a*, 122*b*), a vertical movement of the shovel stem (9") can be made without entraining the buckets. The means of support which make it possible to direct and maintain the buckets in a precise angular position include V-notches (410*a*, 410*b*) worked onto the uprights of the support and on which the parts (128*a*) and (128*b*) of the buckets (120*a*) and (120*b*) whose section matches the complementary shapes come to rest. A second support is used, equipped with the same means to support and hold the buckets in position and which is provided with two new buckets is made available. Between detaching the old buckets and attaching the new buckets, the pivot-members have been prevented from rotating. In this way, the first fixing means are in the right position from the start when they make contact with the second fixing means during fastening of the new buckets.

The invention claimed is:

1. Fastening device designed to fasten a collecting container swiveling around an axis at an end of a mobile arm, the collecting container having an opening making it possible to collect solid remains during the swiveling, the fastening device comprising:

a. at least one pivot-member assembled so as to swivel around the axis on the end of the mobile arm and including:

at least one first transverse arm fastened to the pivot-member and provided with a first fixing means; and at least one second transverse arm fastened to the pivot-member and provided with a first group of bores directed in a direction parallel to the axis;

b. at least first and second fasteners fixed onto the collecting container:

the first fastener being provided with a second fixing means configured to work in conjunction with the first fixing means of the pivot-member, so that, when the first fixing means and the second fixing means come into contact with each other, the second fixing means is configured to be used as a guide and then as a stop to the first fixing means when the pivot-member swivels around the axis in a given direction of rotation;

the second fastener being provided with a second group of bores turned in a direction parallel to the axis, placed so that when the pivot-member swivels in the given direction of rotation until the first fixing means is configured to come up against the second fixing means, such that the bores of the first group and the bores of the second group are substantially aligned in a common axial direction;

c. a pin, designed to be inserted and to slide in the alignment of the bores of the first and second groups, in order to fix the collecting container onto the end of the mobile arm;

characterized in that:

d. the first group of bores includes a number m of bores, and the second group of bores includes a number n of bores, wherein m and n are integers equal to or greater than 1, with a product of m*n being strictly greater than 1;

e. when the bores of the first and second groups are substantially aligned, there exists at least one central bore of one of the first and second groups, the at least one central bore being conical and surrounded by a small diameter peripheral bore and a large diameter peripheral bore of the other of the first and second groups, the small diameter peripheral bore and the large diameter peripheral bore being cylindrical and having different diameters;

f. the pin is a twin-cylindrical shaft with a conical shoulder including:

f1) first and second cylindrical parts, the first cylindrical part having a diameter slightly lower than a diameter of the small diameter peripheral bore in which the first cylindrical part is designed to slide, and the second cylindrical part having a diameter slightly lower than a diameter of the large diameter peripheral bore in which the second cylindrical part is designed to slide;

f2) and a conical intermediate part, a slope of which is similar to a slope of the central bore.

2. Fastening device according to claim 1, characterized in that the fastening device also includes complementary means of axial immobilization of the pin on a transverse face of the pin located on a side of the second cylindrical part and a wall bearing the small diameter peripheral bore on a transverse face located on a side opposite to the large diameter peripheral bore.

3. Fastening device according to claim 1, characterized in that the second transverse arm bears the large and small diameter peripheral bores, the second transverse arm including two flanges parallel to each other, each of the flanges bearing one of the large and small diameter peripheral bores, the flanges having opposite faces separated by a distance D greater than a thickness E of a wall of the second fastener which bears the central bore.

4. Fastening device according to claim 3, in which a first of the flanges bears the large diameter peripheral bore and a second of the flanges bears the small diameter peripheral bore, wherein the second flange is provided with a sleeve projecting in a direction of the first flange, wherein the sleeve has a projecting end that acts as an axial stop for the wall of the second fastener, which bears the central bore.

5. Fastening device according to claim 4, in which the axial stop of the projecting end is axially offset in relation to the second flange bearing the small diameter peripheral bore which corresponds to half of a difference between the distance D between the opposite faces of the first and second flanges and the thickness E of the wall of the second fastener.

6. Fastening device according to claim 2, in which the pin is provided with an axial bore and in which the means of axial immobilization include a screw and a nut, a body of the screw being inserted inside the axial bore, and a head of the screw and the nut bearing, directly or via washers, on an end of the pin close to the second cylindrical part and on a transverse face interdependent of a flange of the second transverse arm bearing the small diameter peripheral bore located on a side opposite the large diameter peripheral bore.

7. Fastening device according to claim 1, in which the first fixing means and the second fixing means belong to a group including a tenon directed in parallel to the swivel axis and at least one slot designed to receive and guide the tenon until the tenon comes up against a bottom of the slot.

8. Fastening device according to claim 7, in which a distance between centers of the first fixing means and the bores of the first group are slightly greater, for a distance between centers of approximately 350 mm, than a distance between centers of the second fixing means and the bores of the second group.

9. Fastening device according to claim 1, in which the collecting container is a bucket bounded by an axial wall and two transverse walls in which:

the pivot-member includes, in a vicinity of each of two ends, the first transverse arm used as support for a tenon directed axially and, in a vicinity of a center of the pivot-member, the second transverse arm including a first flange bearing the large diameter bore and a second flange, parallel to the first flange and bearing the small diameter bore, the axial wall of the bucket includes two first fasteners, each provided with a slot, the first fasteners placed axially and separate from each other by a distance close to a length of the tenon, each slot of each first fastener being designed to receive and guide the tenon until the tenon comes up against bottoms of the slots;

the second fastener provided with a conical bore, placed so that a distance between an axis of the conical bore and a line connecting centers of curves of the bottoms of the slots is slightly lower, for a distance between centers of approximately 350 mm, than a distance between an axis of the tenon and a common axial direction of the large diameter and small diameter bores.

10. Fastening device according to claim 1, in which the pivot-member is actuated by at least one actuator which is also used to actuate the collecting container and which is assembled interdependently of the mobile arm.

11. Fastening device according to claim 10, in which the actuator is a jack and in which the pivot-member includes at least one transverse arm provided with a clevis pin on which a rod connected to the jack can be fitted to swivel.

12. Fastening device according to claim 1, in which the given direction of rotation corresponds to a closing movement of the collecting container, made to collect the remains.

13. Fastening device according to claim 12, in which the first fastener is placed close to the opening of the collecting container and is provided with a slot towards a side opposite to the opening.

14. Fastening assembly designed for the simultaneous fastening of first and second buckets placed opposite each other, substantially symmetrically in relation to a plane P1, characterized in that the fastening assembly comprises, associated with each of the first and second buckets, placed in substantially symmetrically in relation to a plane P2, a fastening device according to claim 1, the mobile arm being actuated by a first actuator so that with a view to fastening, plane P1 is configured to coincide with plane P2, a first pivot-member associated with the first bucket and a second pivot-member associated with the second bucket each having at least one transverse arm bearing a swivel connection with a connecting rod connected to at least one second actuator, interdependent of the mobile arm, each of the swivel connections being placed in relation to a corresponding one of the first and second pivot-members so that a relative movement of the connecting rod gives, for each of the first and second buckets, a substantially symmetrical rotation movement in relation to the plane P2.

15. Collection unit comprising a mobile arm, at least one collecting container actuated by at least one actuator interdependent of the mobile arm and, associated with the collecting container, at least one fastening device according to claim 1.

16. A collection unit comprising a mobile arm, first and second buckets placed opposite each other, actuated simultaneously by at least one actuator interdependent of the mobile arm, and a fastening assembly for the first and second buckets characterized in that the fastening assembly is a fastening assembly according to claim 14 allowing simultaneous fastening of the first and second buckets, fastening being possible when the first and second buckets have been previously placed substantially symmetrically in relation to the plane P1.

17. Collection unit according to claim 16 characterized in that:

the mobile arm is a mobile vertical mast borne by a carriage of an overhead traveling crane, actuated by a first actuator which moves the mobile vertical mast along a vertical axis of the mobile vertical mast;

the first and second pivot-members each have at least one transverse arm bearing a swivel connection with a connecting rod connected to at least one second actuator, interdependent of the mobile arm, the swivel connections being placed on each transverse arm so that a relative movement of the connecting rod gives, for each of the first and second pivot-members, a substantially symmetrical rotation movement in relation to the plane P2, which is substantially vertical.

18. Crust shovel designed to collect solid remains and mud found in liquid media of an aluminum production cell characterized in that the crust shovel comprises a collection unit according to claim 17, in which the mobile vertical mast is a moving part of a telescopic mast connected to a tool-holder turret of a mobile carriage of a pot tending machine.

19. Service machine that can be used in a plant for producing aluminum by igneous electrolysis, comprising a carriage that can be moved on an overhead traveling crane, and a service module equipped with a plurality of handling and servicing devices, characterized in that the service machine is provided with a crust shovel according to claim 18.

20. Bucket support configured to work in conjunction with the fastening assembly of claim 14 for the simultaneous fastening of the first and second buckets opposite each other, in which planes P1 and P2 are vertical, characterized in that the bucket support includes means to support and maintain in position the first and second buckets placed in substantially symmetrically in relation to the vertical plane P1, in a geometrical configuration where the first and second buckets are open at an opening angle, the opening angle being such that, after removing the pin and after a slight rotation of the first and second pivot members in an opening direction to release the first fixing means from the second fixing means, a vertical movement at a top of the mobile arm can be made to move away the first and second pivot-members without actuating the first and second buckets.

* * * * *